United States Patent [19]

Makins

[11] Patent Number: 4,776,044

[45] Date of Patent: Oct. 11, 1988

[54] HAT WITH AUDIO EARPHONES

[76] Inventor: J. Patrick Makins, P.O. Box 10459, Bainbridge Island, Wash. 98110

[21] Appl. No.: 80,415

[22] Filed: Jul. 30, 1987

[51] Int. Cl.[4] ..... A42B 1/24

[52] U.S. Cl. ..... 2/199; 2/172; 2/209; 381/187

[58] Field of Search ..... 2/199, 185 R, 172, 209, 2/423, 6; 381/187, 183

[56] References Cited

U.S. PATENT DOCUMENTS

| | | | |
|---|---|---|---|
| 2,869,134 | 1/1959 | Milstein | 2/172 |
| 3,518,701 | 7/1970 | Fekete | 2/172 |
| 4,109,105 | 8/1978 | Von Statten, Jr. | 381/187 X |
| 4,523,661 | 6/1985 | Scalzo et al. | 381/187 X |
| 4,669,129 | 6/1987 | Chance | 2/209 |

FOREIGN PATENT DOCUMENTS

| | | | |
|---|---|---|---|
| 0777946 | 12/1934 | France | 381/187 |
| 2638204 | 6/1984 | France | 2/209 |
| 0593942 | 5/1959 | Italy | 2/423 |
| 0442606 | 2/1936 | United Kingdom | 2/423 |
| 1179946 | 2/1970 | United Kingdom | 381/187 |

*Primary Examiner*—Peter Nerbun

*Attorney, Agent, or Firm*—Wells, St. John & Roberts

[57] ABSTRACT

A hat is described having a set of audio earphones releasably mounted in earflaps that cover the user's ears. The earphones are disc shaped mini-speakers having a thin profile that are insertable in a pocket between an inner wall and outer wall of each flap. Each earphone is releasably held in place by a hook-loop connection. Preferably a loop fabric is formed as the inner lining of the inner wall and a hook patch is secured onto the grill face of the earphone. The user may adjust the position of the earphone with the pocket to individually fit the earphones in relation to his ears. The hook-loop connection prevents the earphones from moving within the pocket when the user is subjected to acceleration forces that are typical in vigorous activity such as skiing.

9 Claims, 2 Drawing Sheets

HAT WITH AUDIO EARPHONES

TECHNICAL FIELD

This invention relates to having ear audio earphones.

BACKGROUND OF THE INVENTION

With the miniaturization of electronics, there have been a substantial increase of portable radios and tape recorders that people desire to utilize or enjoy while involved in an activity. Considerable interest has developed in the use of headsets that are connected to portable radios and/or cassette players that people can take from one location to another. Some of the radios and cassette players are sufficiently portable that they can be readily carried while a person is walking to enjoy music from the cassette player or news or other broadcast material from a radio. However, it has been difficult to devise a portable audio system that is readily and conveniently utilized by persons who are involved in rather strenuous outdoor activities during the winter.

One of the objectives of this invention is to provide a hat with ear audiophones in which the position of the ear audiophones may be readily adjusted but secured in the adjusted position to provide excellent acoustical relationship to the person's ears.

A futher object of this invention is to provide a hat with ear audiophones that can be easily and conveniently mounted and inexpensively constructed to enable the wearer to have maximum comfort from the use of a hat and have optimum acoustical characteristics without a great deal of adjustment or inconvenience when putting on or taking off the hat.

BRIEF DESCRIPTION OF THE DRAWINGS

The preferred embodiment of the invention is illustrated in the accompanying drawings, in which.

DETAILED DESCRIPTION OF THE PREFERRED EMBODIMENT

The following disclosure of the invention is submitted in compliance with the constitutional purpose of the Patent Laws "to promote the progress of science and useful art" (Article 1, Section 8).

Figure 1:
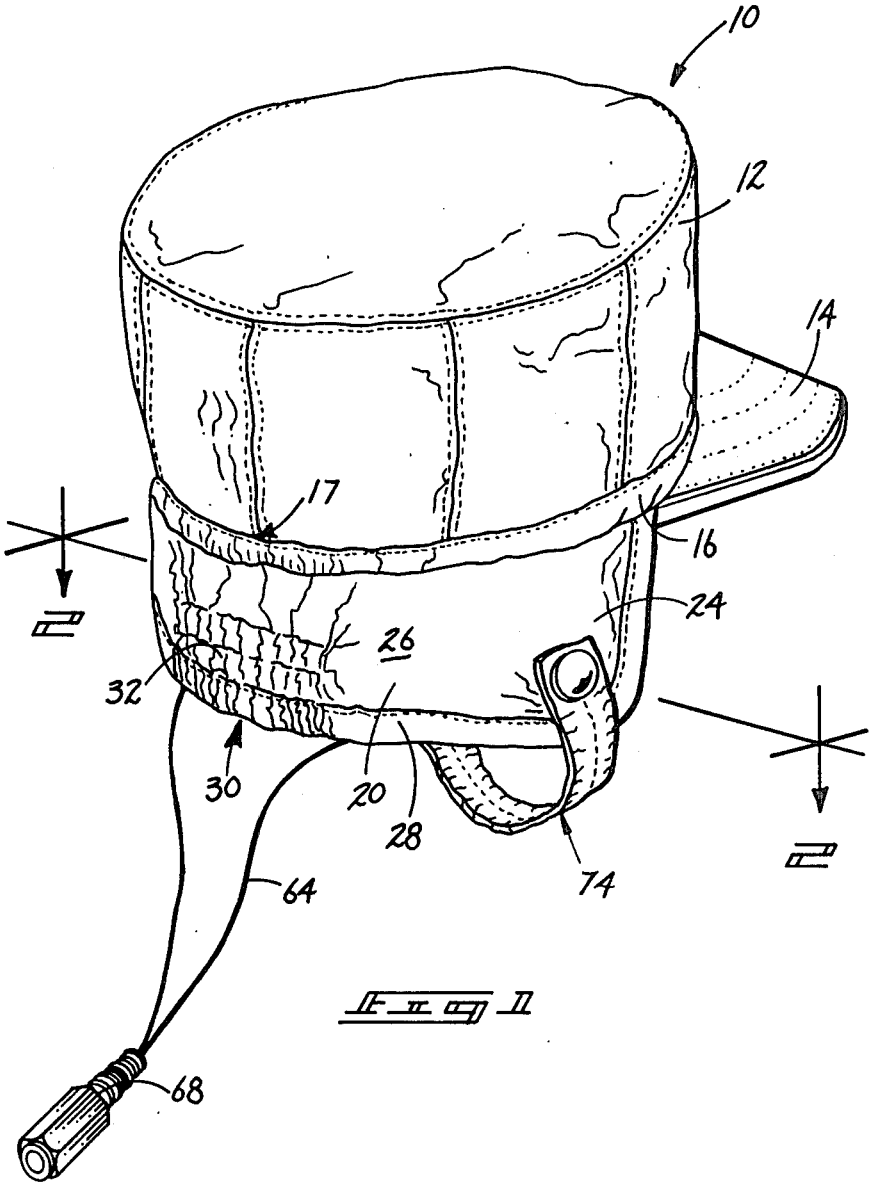
FIG. 1 is a perspective view of a hat having ear audiophones mounted therein for enabling the user to enjoy music or listen to a portable radio or cassette player.
Figure 2:
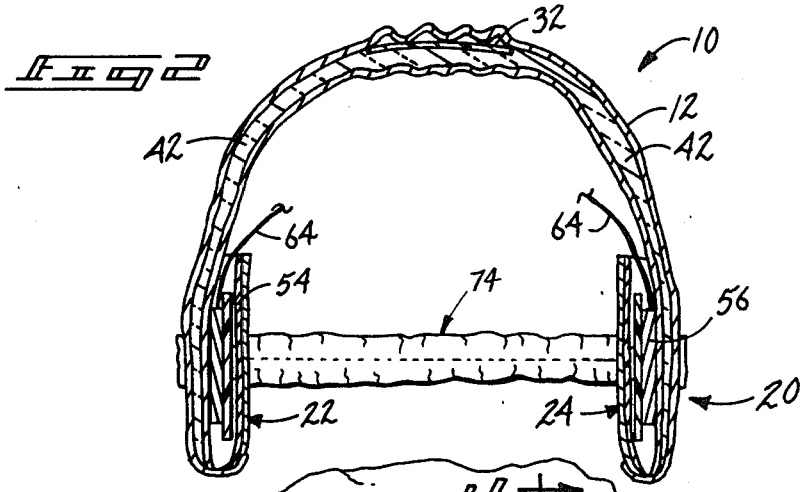
FIG. 2 is a vertical cross-sectional view taken along line 2—2 in FIG. 1 illustrating the hat, with paticular emphasis on earflaps of the hat.
Figure 3:
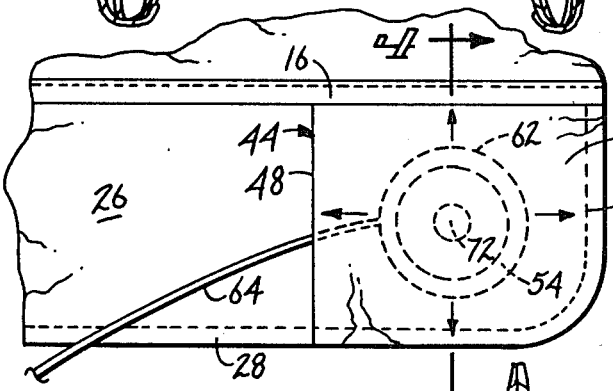
FIG. 3 is an enlarged inside view of one of the earflaps illustrating the location and position of an earphone.

A hat with earphones designated generally with the numeral 10 is described and illustrated in FIG. 1. The hat includes a crown 12 with a brim 14. The crown and brim are interconnected through a structural headband 16. As illustrated in FIG. 1, a portion of the headband at the back portion includes an elastic section 17 to easily accommodate the hat firmly to the head. Preferably the crown has a lining 18 that is additionally stitched to the structural band 16 (FIG. 2).

The hat 10 includes an ear flap assembly 20 that is operatively connected to the stuctural band 16 and is adapted to extend downwardly therefrom over the user's ears. The ear flap assembly 20 includes a left ear flap 22 and a right ear flap 24. Preferably the ear flaps 22 and 24 are interconnected by a neck collar 26 illustrated in FIG. 1. In a preferred embodiment the ear flaps 22 and 24 and the interconnecting neck collar 26 are integral with the neck collar extending about the back of the user's head below ear level. The flaps 22, 24 and the neck collar 26 have a peripheral binding 28.

The hat 10 includes a biasing means generally designated with the numeral 30 for biasing the ear flaps 22 and 24 towards each other and against the user's ears to hold the flaps snugly in place. In a preferred embodiment, the biasing means 30 includes an elastic section 32 formed in interconnecting neck collar 26 for biasing the flaps 22 and 24 towards each other and against the user's ears. It is advantageous to keep the ear flaps 22 and 24 in engagement with the user's ears to improve the acoustical transmission characteristics of the hat.

Figure 4:
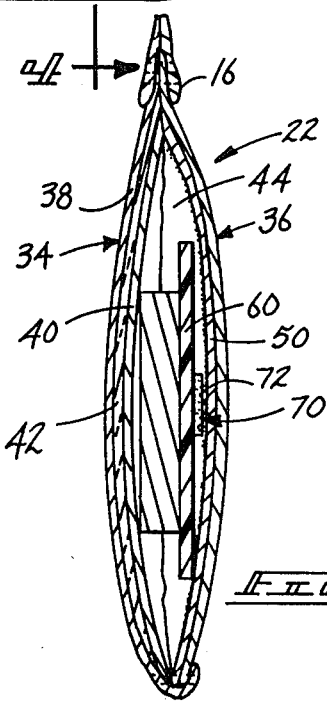
FIG. 4 is a cross-sectional view taken along line 4—4 in FIG. 3 showing in detail an earphone mounted in a pocket within one of the earflaps.

Each of the flaps 22, 24 include an outer wall 34 and an inner wall 36 as illustrated in detail in FIG. 4.

The outer wall 34 includes an outer layer or shell 38 and an inner layer or lining 40 with a thermal insulation layer 42 positioned therebetween. The thermal insulation layer 42 not only increases the thermal characteristics of the hat in protecting the user from the elements but the thermal insulation additionally improves the acoustical characteristics of the system by dampening possibly reflective sound waves.

Each of the flaps 22 and 24 include an earphone pocket 44 for receiving an acoustical earphone. The pocket is defined by a seam 46 with a rear opening 48 formed in the pocket to permit the user to insert or remove an earphone from the pocket through the rear opening.

Each of the inner wall 36 include an outer layer or shell 50 and an inner lining 52. Preferably the inner lining 52 is formed of a loop-type fabric.

The hat 10 includes earphones 54, 56 that are mounted within the flaps 22 and 24 respectively and more specifically within the respective pockets 44. Earphones 54 is preferably mouted in the left ear flap 22 and earphones 56 is mounted in the right ear flap 24. Preferably each of the earphones 54 and 56 are disk shape having a very thin profile to fit comfortably between the inner wall 36 and the outer wall 34 in the pockets 44. Each of the earphones 54, 56 including a front face 58 having a speaker grill formed thereon that faces and engages the inner lining 52. Each of the earphones 54, 56 have a back face 60 that incorporates the diaphragm cone of the speaker or the transducer. Each of the earphones 54, 56 include a periphery 62 that has a dimension less than the major dimension of the pocket so that the earphones 54, 56 can easily be inserted into or removed from the pockets 44. Preferably of the ear phones 54 and 56 have a frequency response of between 20 Hz and 20 kHz. Additionally in a preferred embodiment the impedance of each of the earphones should be between 8 and 32 ohms. In a preferred embodiment the diameter of the periphery 62 should be approximately 40 millimeters.

Figure 5:
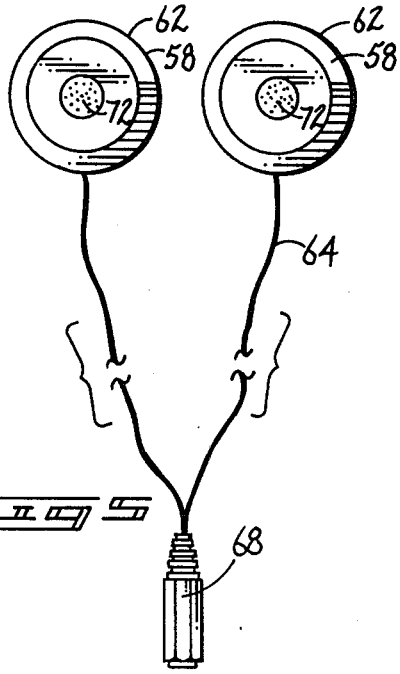
FIG. 5 is a schematic view showing the earphones removed from the hat with the earphones connected to a pig tail cable.

The hat further includes a speaker cable 64 that is connected between the earphones 54, 56 and an audio pig tail connector 68. The pig tail connector can be either a male or female plug depending upon the desired design. Preferably the cable 64, the connector 68 and the earphones 54, 56 are interconnected and removable from the hat as illustrated in FIG. 5. This enables the hat to be cleaned without damaging the earphones and the electrical connection. It is preferable that the speaker cable 64 be rather short and extend downward from the hat a short distance for connecting to either a portable receiver/transmitter or to an extension cable that extends from the electrical connector 68 to the portable receiver/transmitter. Often the user desires to position the receiver/transmitter in his pocket. In such case, an extension cable is needed to extend from the portable receiver/transmitter to the back of the person or neck area for connecting to the electrical connector 68.

The hat 10 further includes an adjustable securing means generally designated with the numeral 70 of the hook-loop configuration for adjustably securing the earphones 54, 56 accurately within the pocket 44. Such a hook-loop connection is sold under the brand name "Velcro." Preferably the inner lining 52 with the loop fabric forms one member of the securing means 70. The other member is a hook patch 72 that is affixed to the grill on the front face 60 of the earphones 54, 56. Preferably the patch 72 has a dot shape and is mounted concentrically with respect to the periphery 62 as illustrated in FIG. 5. The hook patch 72 when engaged with the loop fabric 52 secures the earphones 54, 56 within the pocket at the specific location of engagement. It is very advantageous to the able to secure the earphones securely within the pocket so that when the hat is worn, the earphones do not slide or move around within the pocket but retain their position. Furthermore, the adjustable securing means 70 enables the earphones to be released from the inner lining 52 by disconnecting the patch 72 from the inner lining 52 and moving the earphones to a more appropriate position with respect to the user's ears to improve the acoustical relationship between the earphone and the user's ears to enhance the acoustical properties of the system.

The hat 10 is particularly adapted and useful for winter sports and winter activities such as hunting and skiing and the like in which the user's hands are occupied with an activity, in which the user desires to listen to music or to the news or his favorite broadcast. Because of the biasing means 30, the ear flaps are kept in engagement with the ears which minimizes intrusion of exterior noises and minimizes wind "whistling," particularly for skiers. In a preferred configuration, the hat includes are chin strap 74 that further holds the ear flap firmly against the user's ears.

In compliance with the statute, the invention has been described in language more or less specific as to structural features. It is to be understood, however, that the invention is not limited to the specific featurs shown, since the means and construction herein disclosed comprise a preferred form of putting the invention into effect. The invention is, therefore, claimed in any of its forms or modifications within the proper scope of the appended claims, appropriately interpreted in accordance with the doctrine of equivalents.

I claim:

1. A hat and ear audiophones, comprising:

a hat body adapted to fit on a person's head;

said hat body having a structural headband intended to encircle the head immediately above the person's ears;

ear flaps operatively connected to the hat body and intended to extend downwardly over the person's ears from the structural headband;

each of said ear flaps having an inner and an outer wall that a interconnected to form a pocket therebetween with a rear opening;

an earphone removably mounted in each pocket through the rear opening with the earphone facing the inner wall;

adjustable securing means within each pocket for releasably securing the earphones within the pockets at various locations to enable the person to adjust the position of the earphones vertically and horizontally with respect to the person's ears to obtain the most desirable audio transmission; and an electrical pig tail cable operatively contained between the earphones and an audio plug for enabling the person to directly or indirectly connect the earphones to a signal transmitter.

2. The hat as defined in claim 1 wherein the hat has means for biasing the ear flaps against the person's ears.

3. The hat as defined in claim 2 wherein the hat has an elastic band extending between the ear flaps along a back portion of the head to bias the ear flaps against the user's ears to improve the audio transmission between the earphones and the person's ears.

4. The hat as defined in claim 3 wherein the hat includes a neck collar attached to the structural band and extending downwardly below the person's ears and interconnecting the ear flaps in which the elastic band is formed as part of the neck collar.

5. The hat as defined in claim 1 wherein the adjustable securing means includes a flexible hook-loop releasable securing means having a first hook-loop member in a pocket affixed to the inner wall and a second hook-loop member affixed to a face of the earphone.

6. The hat as defined in claim 5 wherein the first hook-loop member is a loop fabric lining of the inner wall of the pocket and wherein the second hook-loop member is a patch of hook material affixed to a earphone to enable the person to adjust the position of the earphone in the pocket.

7. The hat as defined in claim 1 wherein each of the earphones are disk shaped having a thin body that fits in the pocket with a front face covered by a diaphragm grill and wherein securing means includes, (1) a loop fabric lining of the inner wall of the pocket, and (2) a patch flexible hook material affixed to the diaphragm grill for realeasably securing the earphone to the inner wall of the pocket.

8. The hat as defined in claim 1 wherein each of the pockets are enclosed except for a rear opening through which the earphones are inserted or removed and wherein each of the earphones are disk shaped having a thin body to fit between the inner and outer wall of the ear flaps.

9. The hat as defined in claim 1 wherein the outer wall of each ear flap is thermally insulated to provide an acoustical dampener to reduce acoustical reflections.

* * * * *